US008122801B2

(12) United States Patent
Weber

(10) Patent No.: US 8,122,801 B2
(45) Date of Patent: Feb. 28, 2012

(54) DEVICE FOR SLICING FOOD PRODUCTS

(75) Inventor: Gunther Weber, Zachow (DE)

(73) Assignee: Weber Maschinebau GmbH & Co. KG, Breidenbach (DE)

( * ) Notice: Subject to any disclaimer, the term of this patent is extended or adjusted under 35 U.S.C. 154(b) by 1326 days.

(21) Appl. No.: 10/556,691

(22) PCT Filed: Apr. 2, 2004

(86) PCT No.: PCT/EP2004/003521

§ 371 (c)(1),
(2), (4) Date: Dec. 28, 2005

(87) PCT Pub. No.: WO2004/106018

PCT Pub. Date: Dec. 9, 2004

(65) Prior Publication Data

US 2006/0283297 A1 Dec. 21, 2006

(30) Foreign Application Priority Data

Jun. 2, 2003 (DE) ..... 10324837

(51) Int. Cl.
*B26D 5/04* (2006.01)

(52) U.S. Cl. ..... 83/402; 83/98; 83/321; 83/932; 414/676

(58) Field of Classification Search ..... 83/98, 321, 83/402, 169, 932; 99/443 R, 443 C; 414/676, 414/903

See application file for complete search history.

(56) References Cited

U.S. PATENT DOCUMENTS

| | | | | |
|---|---|---|---|---|
| 3,052,339 | A * | 9/1962 | Carter | 198/460.1 |
| 3,204,676 | A * | 9/1965 | Gillman | 83/73 |
| 3,851,554 | A * | 12/1974 | Papai | 83/165 |
| 4,298,413 | A * | 11/1981 | Teare | 156/42 |
| 5,794,500 | A | 8/1998 | Long et al. | 83/22 |
| 5,979,302 | A * | 11/1999 | Funk et al. | 99/339 |
| 6,252,201 | B1 * | 6/2001 | Nevarez | 219/388 |
| 2002/0069937 | A1 * | 6/2002 | Murray | 144/379 |
| 2003/0188615 | A1 * | 10/2003 | Ripley | 83/152 |
| 2005/0034576 | A1 * | 2/2005 | Ray et al. | 83/13 |
| 2005/0098016 | A1 * | 5/2005 | Benuzzi | 83/733 |

FOREIGN PATENT DOCUMENTS

| | | |
|---|---|---|
| DE | 38 18 474 | 12/1989 |
| DE | 40 10 199 | 3/1992 |
| FR | 2 795 014 | 12/2000 |
| GB | 2 352 675 | 2/2001 |
| JP | 63-051245 | 3/1988 |
| JP | 61-54493 | 6/1994 |

* cited by examiner

*Primary Examiner* — Laura M. Lee

(74) *Attorney, Agent, or Firm* — Gifford, Krass, Sprinkle, Anderson & Citkowski, P.C.

(57) ABSTRACT

A device for slicing food product having a conveyor which transports the food product toward a cutting edge. An air cushion is provided between an end of the conveyor and the cutting edge which elevates and guides the food product.

7 Claims, 2 Drawing Sheets

DEVICE FOR SLICING FOOD PRODUCTS

CROSS-REFERENCE TO RELATED APPLICATIONS

This application is a National Stage of International Application No. PCT/EP2004/003521, filed Apr. 2, 2004, and which claims priority to German Patent Application No. DE 103 24 837.4, filed Jun. 2, 2003. The disclosures of the above applications are incorporated herein by reference.

FIELD OF THE INVENTION

The invention relates to an apparatus for the slicing of food products such as sausage, cheese, ham and the like comprising an arrangement including at least one transport belt for the supply of the respective product to be sliced in a fast cutting sequence to a cutting plane in which a cutting knife orbits while adjoining a cutting edge forming the end of the product supply device.

BACKGROUND OF THE INVENTION

In known apparatuses of this kind, which are also termed slicers and which slice the respectively supplied products into slices of a pre-settable thickness in a fast cutting sequence, the respective products are supplied to the cutting plane via at least one transport belt. This transport belt ends at a spacing in front of the cutting plane of, for example, approximately 20 to 70 mm and the region of the product supply device between the cutting plane and the end of the transport plane is formed by a stationary region or by stationary surfaces of the product supply device. The product to be sliced must be fed in the direction of the cutting plane via this stationary region and, in the case of the carrying out of blank cuts, must also be moved in the opposite direction, with a comparatively high friction or adhesion occurring at these stationary surfaces, in particular with sticky products such as cheese, due to the forces exerted onto the product in the cutting processes.

These unwanted adhesion and/or friction effects make the feed and also the return of the respective product more difficult, on the one hand, and can also result in deformations of the product. As a consequence of this, irregularities in the slice thickness and also the formation of chips can occur, on the one hand, and loosening actions of the product holder at the end side in the product can occur due to the feed and return movements making adhesion more difficult, on the other hand, which can have a negative effect with respect to the interference-free work always aimed for.

Attempts have already been made in practice to reduce the disturbing adhesion and friction effects in that the product contact surface was reduced by the introduction of grooves or in that rollers were provided in the region adjacent to the cutting edge; however, all of these attempts have proved unsuitable due to the dangers of contamination associated with them and to the cleaning problems which arise.

SUMMARY OF THE INVENTION

It is the object of the invention to develop an apparatus of the initially named kind comprising simple means which do not result in any problems of contamination or cleaning such that disturbing friction and adhesion effects, in particular in connection with sticky products, are practically completely eliminated in the stationary region of the product supply device disposed in front of the cutting edge.

This object is satisfied in accordance with the invention in that the region of the product supply device disposed between the end of a transport belt carrying the product to be sliced and the cutting edge adjoining the cutting plane is provided at least regionally with means for the forming of at least one air cushion between the product and at least one product-carrying surface.

The difficulties described above can be eliminated in full by a formation of an air cushion which can be directly realized and a precise supply of the products to the cutting plane can take place even with so-called critical products which does not result in irregularities due to disturbing friction and adhesion effects, with product retraction movement also being able to be carried out equally fast and free of disturbance so that chip formation and product holder loosening actions are practically precluded.

In accordance with a possible optimization of the procedure achievable by the invention, the bores provided for the formation of the air cushion can be acted on individually or also group-wise by compressed air in dependence on the peripheral contour, on the type and/or on the weight of the product to be sliced, whereby the consumption of compressed air can be minimized without compromises in function.

It is also possible to carry out the action on the bores with compressed air in dependence on the feed movements and/or retraction movements of the respective product and, optionally, also in a pulsating manner.

The bores can have different opening cross-sections and/or axis inclinations and/or mutual spacings in dependence on their position in the stationary region of the product guidance, i.e. the density of the bores in the stationary region can also be selected in dependence on the more or less strong pressure strain in this stationary region.

It is furthermore possible to form the bores in one or more distributor plates which can be inserted in a shape matched and exchangeable manner into the stationary region of the product guidance so that different products can be taken into account by a simple exchange of the distributor plates.

The stationary region of the product guidance fixing the cutting edge is admittedly frequently made right angled, but the invention is also easily realizable in the manner described when the stationary region of the product guidance is made in the manner of a shaped shell surrounding the product to be sliced in full or in part.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
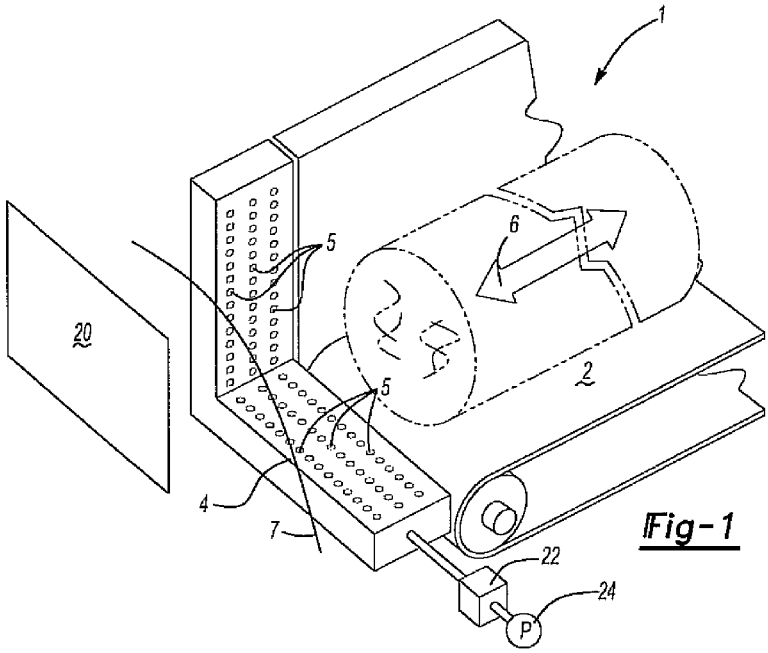
FIG. 1 is an elevational view showing a preferred embodiment of the invention.
Figure 2:
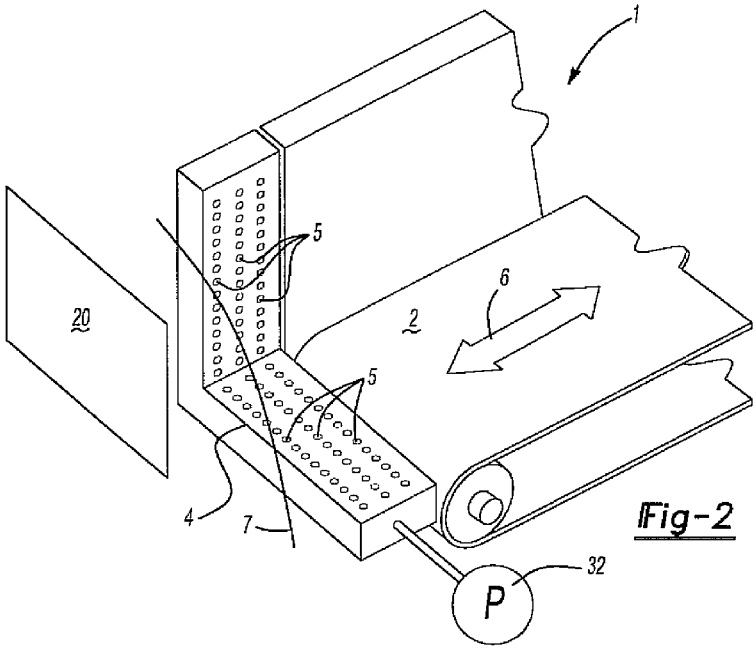
FIG. 2 is a view similar to FIG. 1, but illustrating a mortification thereof.

The following description of the preferred embodiment(s) is merely exemplary in nature and is in no way intended to limit the invention, its application, or uses.

The product supply device is characterized by the general reference numeral 1 and includes, in the example shown, a transport belt 2 on which the respective product to be sliced lies and by means of which it is transported in the direction of the schematically indicated cutting plane 7. This transport belt is—as indicated by the double arrow 6—drivable in the feed direction and in the retraction direction in order to be able to retract the product from the cutting plane 7 in the case of blank cuts.

A stationary region 3 of the product supply device is located between the cutting plane 7 and the end of the transport belt 2 and is made in an angular manner in the example shown and has a cutting edge 4 which cooperates with a knife 20 orbiting in the cutting plane 7. The knife can, for example, be a planetary driven knife or also a scythe-like blade. The stationary region 3 of the product supply device 1 forms product guidance surfaces and a plurality of bores 5, which are connected to one or more compressed air sources, open into these product guidance surfaces.

These bores 5 can be arranged in regular distribution over the stationary region 3 as shown in FIG. 1, or irregular distribution over the stationary region 3, with the bore density in particular preferably being selected to be larger in those surface regions in which the biggest pressure forces occur in cutting operation.

Instead of the right-angled embodiment of the stationary region 3 shown in the embodiment, it is also possible to make this stationary region as a shaped shell which surrounds the product to be sliced in full or in part and in which corresponding bores 5 are then provided.

Far-reaching freedoms exist with respect to the selection of the diameter and of the cross-sectional shape of the bores as well as of the choice of the axis direction of the bores for the purpose of optimum adaptation to the respective products to be sliced. The bores can, for example, have a diameter of approximately 5 to 6 mm, with this figure in no way being restrictive. The bores 5 may have different cross sections or be in the shape of a nozzle.

Figure 3:
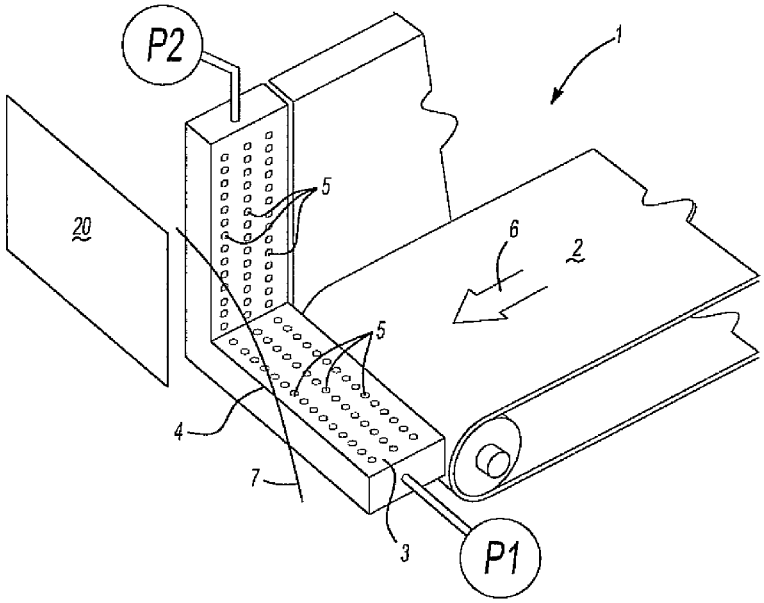
FIG. 3 is a view similar to FIG. 1, but illustrating a modification thereof.

A compressed air control unit 22 for a source of pressurized air 24 to be used in each case and which, optionally, cooperates with product probing means to permit a direct control of bores or groups of bores which are needed to generate air cushions adapted to the respective product and, in this process, to minimize the consumption of compressed air, is shown in FIG. 1. This direct control of bores 5 can also take part in the manner such that work is regionally carried out with different pressures P1 and P2 (FIG. 3) and, optionally, also with a pulsating air supply 32, with it being ensured in all cases that the bores 5 are always kept free by flowing with air standing under overpressure. The air supplied to the bores 5 is filtered to ensure that the products only come into contact with clean air.

The compressed air supply preferably also takes place in dependence on the product transport or in dependence on the friction and adhesion forces which occur so that a generation of air cushions always only takes place when it is required under technical cutting aspects.

Provision can optionally also be made to provide the bores in one or more distributor plates which can be inserted in a shape matched manner, e.g. via a type of dove-tail guidance, and exchangeably into the stationary region 3 of the product supply device. The control of the bores takes place in this case via shallow chambers which are formed beneath the distributor plates used in the stationary region and which are in communication with the respective air source.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. An apparatus for the slicing of food products comprising an arrangement including at least one transport belt (2) for the supply of the respective product to be sliced in a fast cutting sequence to a cutting plane (7) in which a cutting knife orbits while adjoining a cutting edge forming the end of the product supply, the apparatus further comprising:

a region (3) of a product supply device (1) being disposed between an end of the transport belt (2) carrying the product to be sliced; and a cutting edge (4) adjoining the cutting plane (7) and that is provided at least regionally with means for forming at least one air cushion between the product and at least one product-guiding surface.

2. An apparatus in accordance with claim 1, wherein the stationary region (3) of the product supply device (1) following the transport belt (2) is provided with a plurality of bores (5) which can be acted on by compressed air.

3. An apparatus in accordance with claim 2, wherein the bores (5) can be acted on by compressed air of different pressures.

4. An apparatus in accordance with claim 2, wherein at least some of the bores (5) can be acted on by pulsating pressure.

5. The invention as defined in claim 1 and comprising at least two product guiding surfaces, said product guiding surfaces lying in non-parallel planes.

6. The invention as defined in claim 1 and comprising at least two product guiding surfaces, one of said product guiding surfaces lying in a horizontal plane and at least a portion of the other product guiding surface lying in a non-horizontal plane.

7. The invention as defined in claim 1 wherein a width of said region in a direction transverse to the direction of travel of the transport belt is greater than the length of said region in a direction parallel to the direction of travel of the transport belt.

* * * * *